US010185285B2

(12) United States Patent
Ballman et al.

(10) Patent No.: US 10,185,285 B2
(45) Date of Patent: Jan. 22, 2019

(54) COMMON MEDIA REDRIVE SYSTEM FOR BOTH BELT AND HOT ROLL FUSER ASSEMBLIES IN AN IMAGING DEVICE

(71) Applicant: LEXMARK INTERNATIONAL, INC., Lexington, KY (US)

(72) Inventors: Karen Elaine Ballman, Nicholasville, KY (US); Gregory Daniel Creteau, Winchester, KY (US); Donald Eugene Proffitt, II, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/378,675

(22) Filed: Dec. 14, 2016

(65) Prior Publication Data

US 2018/0164740 A1 Jun. 14, 2018

(51) Int. Cl.
*G03G 15/20* (2006.01)
*G03G 21/16* (2006.01)

(52) U.S. Cl.
CPC ..... *G03G 21/1685* (2013.01); *G03G 15/2028* (2013.01); *G03G 21/1633* (2013.01)

(58) Field of Classification Search
CPC ..... G03G 21/1633; G03G 21/1685; G03G 15/23–15/235; G03G 15/238; G03G 15/2017; G03G 2215/00586
See application file for complete search history.

(56) References Cited

U.S. PATENT DOCUMENTS 4,787,616 A * 11/1988 Sasaki ..... B65H 39/11 271/176
5,280,331 A * 1/1994 Namiki ..... G03G 15/234 271/186
6,032,949 A * 3/2000 Ando ..... B65H 9/166 271/186
9,857,759 B1 * 1/2018 Boyatt ..... G03G 21/1647
2003/0209852 A1 * 11/2003 Choi ..... B65H 15/00 271/291
2006/0127127 A1 * 6/2006 Eom ..... G03G 15/234 399/110

(Continued)

FOREIGN PATENT DOCUMENTS

JP 10177314 A * 6/1998

OTHER PUBLICATIONS

Machine translation of JP 10177314. Jun. 30, 1998.*

*Primary Examiner* — Carla J Therrien

(57) ABSTRACT

A common media redrive system for use with either a hot roll fuser assembly and a belt roll fuser assembly installed an imaging device. The redrive systems includes an access door movable between a raised closed and a lowered open position. The access door has a media path channel and a deflector mounted over the channel. The deflector has a pivotable gate and includes upper and lower media guide members forming a media entrance and two exits for directing a media sheet from the fuser assembly exits to an output area and duplex path portion, respectively, via the gate and the first and second exits, respectively. A pair of media exit guide portions cantilever from the rear portion of the fuser assembly. The lower media guide members includes a pair of cutouts that receive the pair of media exit guide portions when the access door is in the closed position.

8 Claims, 18 Drawing Sheets

(56) References Cited

U.S. PATENT DOCUMENTS

| | | | | |
|---|---|---|---|---|
| 2009/0022534 | A1* | 1/2009 | Taniguchi | B65H 29/58 399/397 |
| 2014/0161481 | A1* | 6/2014 | Udagawa | G03G 21/206 399/92 |
| 2015/0309455 | A1* | 10/2015 | Matsumoto | G03G 15/2028 399/323 |

* cited by examiner

COMMON MEDIA REDRIVE SYSTEM FOR BOTH BELT AND HOT ROLL FUSER ASSEMBLIES IN AN IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

Field of the Invention

The field relates generally to a media redrive system for an imaging device and in particular, a media redrive system interfaceable without modification to either a belt fuser or a hot roll fuser used in an imaging device.

Description of the Related Art

Belt and hot roll fuser types transfer media sheets differently in the imaging device. In particular, belt and hot roll fuser types differ with respect to the leading edge conditions and the exit angles of media sheets post-fusing. In a belt fuser type, leading edges of media sheets post-fusing generally curl downwardly while leading edges of fused media sheets in hot roll fuser types tend to curl upwardly. As such, leading edge exit angles of media sheets fused through hot roll fusers are generally higher than leading edge exit angles of media sheets fused through belt fusers.

Variations in the leading edge conditions and paper path exit angles between these two types of fusers have thus driven the need for a different paper path media redrive system on the printer for interfacing with respective rear portions of each fuser type. However, having different media redrive systems, much less, having separate, different media redrive systems specifically designed for accommodating the two fuser types is not only inefficient, but also costly. Accordingly, it would be advantageous to have one media redrive system capable of interfacing with either a hot roll fuser or a belt fuser without the need to modify the media redrive system.

SUMMARY OF THE INVENTION

Disclosed is an imaging device having a media redrive system useable with either a hot roll or belt type fuser assemblies. The media redrive system comprises an access door and a media deflector. The access door is pivotally mounted to the imaging device and movable between a raised closed position and a lowered open position. The access door has an outer and an inner surface and a media path channel along a length thereof with the media deflector mounted on the inner surface.

In one example embodiment, the deflector includes upper and lower media guide members forming an entrance for receiving the media sheet from the rear portion of the fuser assembly and a first and a second exit. A gate is positioned adjacent the entrance and movable between a first position for directing fused media sheets to a media output area in the imaging device via the first exit and a second position for directing fused media sheets to a duplex path portion of the imaging device along a downstream portion of the media path channel via the second exit.

When in the raised closed position, the deflector engages with the rear portion of the removable fuser assembly, which may be one of a hot roll and belt type fuser assembly. Lower media guide members of the deflectors include a pair of cutout portions sized to receive and overlap with a pair of media exit guide portions cantilevered from the rear portion of the removable fuser assembly for providing an interface between the access door and the fuser assembly. The pair of media exit guides and the inner surfaces of the upper and lower media guide members also include a plurality of ribs that are offset from the plurality of ribs on the pair of media exit guides for ensuring smooth transition of fused media sheets from the fuser assembly to the access door.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings.

DETAILED DESCRIPTION

Figure 1A:
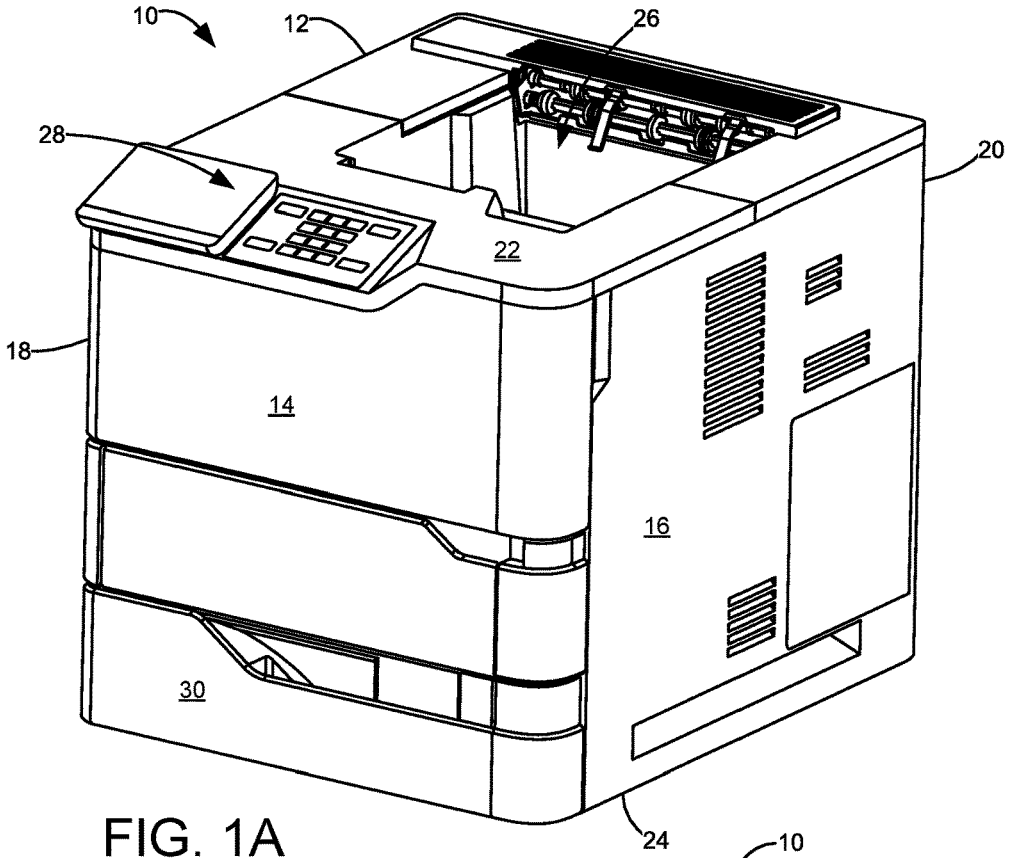
FIGS. 1A and 1B are front and rear perspective views, respectively, of an imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including," "comprising," or "having" and variations thereof herein is meant to encompass the items listed thereafter and equivalents thereof as well as additional items. Terms such as "about" and the like are used to describe various characteristics of an object, and such terms have their ordinary and customary meaning to persons of ordinary skill in the pertinent art.

Terms such as "about" and the like have a contextual meaning, are used to describe various characteristics of an object, and such terms have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Spatially relative terms such as "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description. Further, relative positional terms are used herein. For example, "superior" means that an element is above another element. Conversely "inferior" means that an element is below or beneath another element. The explanations of these terms along with the use of the terms "top", "bottom", "front", "rear", "left", "right", "up" and "down" are made to aid in understanding the spatial relationship of the various components and are not intended to be limiting.

As described in subsequent paragraphs, the specific mechanical configurations illustrated in the figures are intended to exemplify embodiments of the present disclosure and that other alternative mechanical configurations are possible.

The term "image" as used herein encompasses any printed or electronic form of text, graphics, or a combination thereof "Media" or "media sheet" refers to a material that receives a printed image or, with a document to be scanned, a material containing a printed image. The media is said to move along a media path, a media branch, and a media path extension from an upstream location to a downstream location as it moves from the media input trays to the output area of the imaging system. For a top feed media tray, the top of the media tray is downstream from the bottom of the media tray. Conversely, for a bottom feed media tray, the top of the media tray is upstream from the bottom of the media tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging device, and is generally means from an input toward an output of the imaging device.

Media is conveyed using pairs of aligned rolls forming feed nips. The term "nip" is used in the conventional sense to refer to the opening formed between two rolls that are typically located at about the same point in the media path. The rolls forming the nip may be separated apart, be tangent to each other, or form an interference fit with one another. With these nip types, the axes of the rolls are parallel to one another and are typically, but do not have to be, transverse to the media path. For example, a deskewing nip may be at an acute angle with respect to the media feed path. The term "separated nip" refers to a nip formed between two rolls that are located at different points along the media path and have no common point of tangency with the media path. Again, the axes of rotation of the rolls having a separated nip are parallel but are offset from one another along the media path. Nip gap refers to the space between two rolls. Nip gaps may be positive, where there is an opening between the two rolls, zero, where the two rolls are tangentially touching, or negative, where there is an interference fit between the two rolls.

Figure 1B:
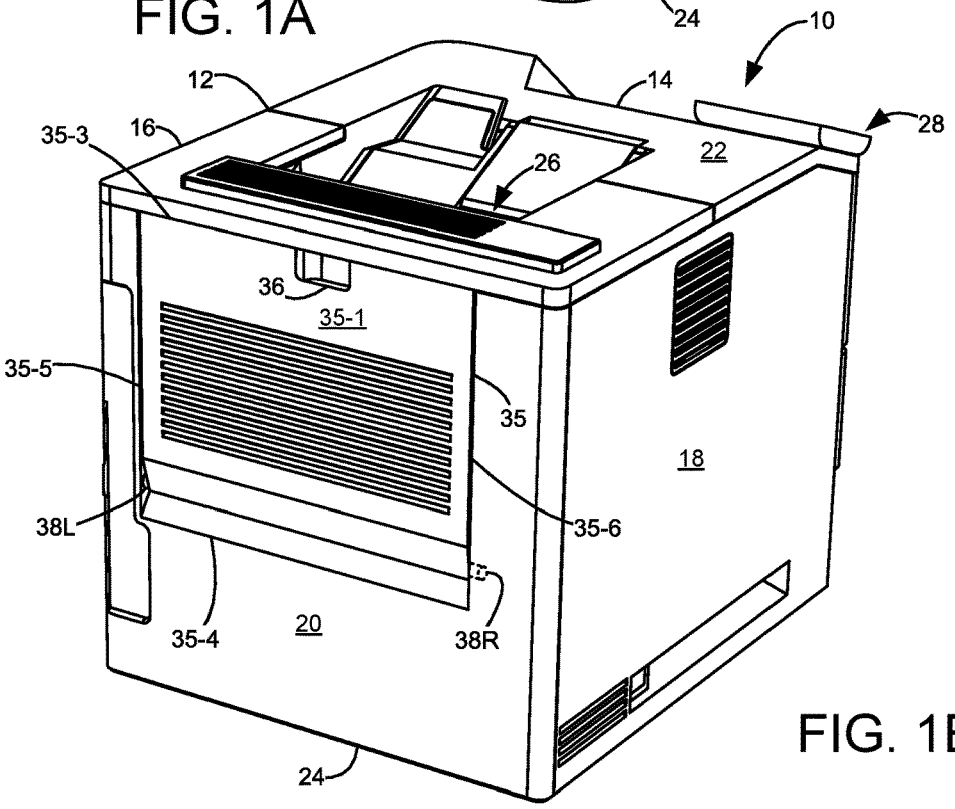

FIGS. 1A and 1B are front and rear perspective views, respectively, of an imaging device 10. Imaging device 10 includes a housing 12 having a front 14, a first and a second side 16 and 18, a rear 20, a top 22 and a bottom 24. A media output area 26 is provided along top 22 for printed media exiting imaging device 10. A user interface 28 is provided along top 22 of imaging device 10 for receiving user input on imaging operations to be performed on the device. A removable media tray 30 for providing media sheets for printing is slidably inserted into imaging device 10 through an opening provided along front 14. A rear access door 35 is provided along rear 20.

FIG. 1B shows access door 35 having an outer surface 35-1 and an inner surface 35-2 (see FIG. 2B) relative to housing 12. Access door 35 also has a top edge 35-3, a bottom edge 35-4, and left and right edges 35-5, 35-6 as viewed in FIG. 1B. A door release 36 is provided along top edge 35-1 of access door 35 for opening access door 35 and allowing access into the interior of imaging device 10 in order to clear a jammed sheet of media from the media path within imaging device 10 or to replace worn components thereof such as a fuser. Access door 35 is pivotally mounted to housing 12 on left and right pivot posts 38L, 38R provided adjacent bottom edge 35-4 of access door 35. Access door 35 is movable between a raised closed position as shown in FIGS. 1A and 1B and a lowered open position as shown in FIG. 2B.

Figure 2A:
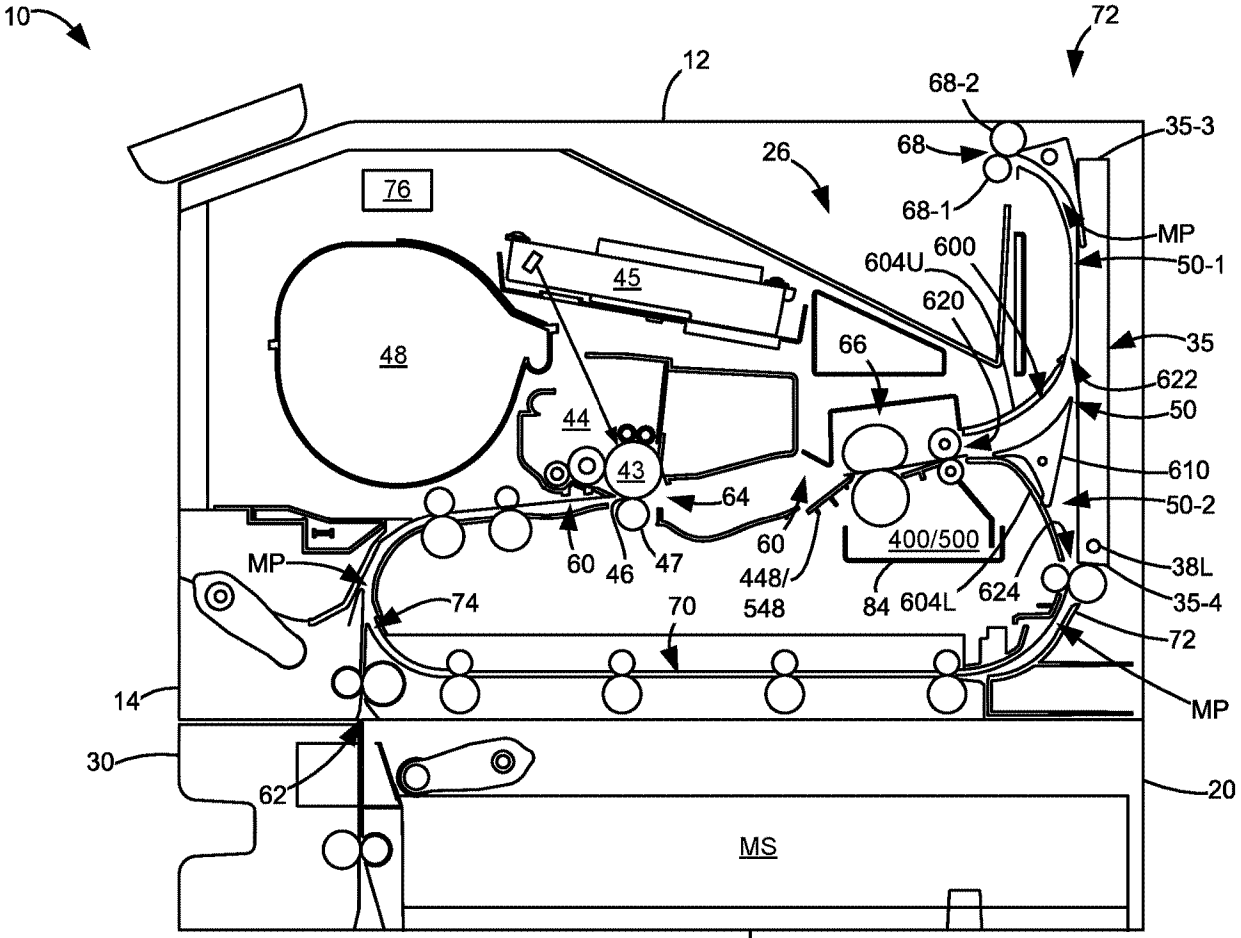
FIGS. 2A and 2B are simplified schematic diagrams of the imaging device in FIGS. 1A and 1B with a rear access door incorporating a portion of the media redrive system shown in closed and open positions, respectively.
Figure 2B:
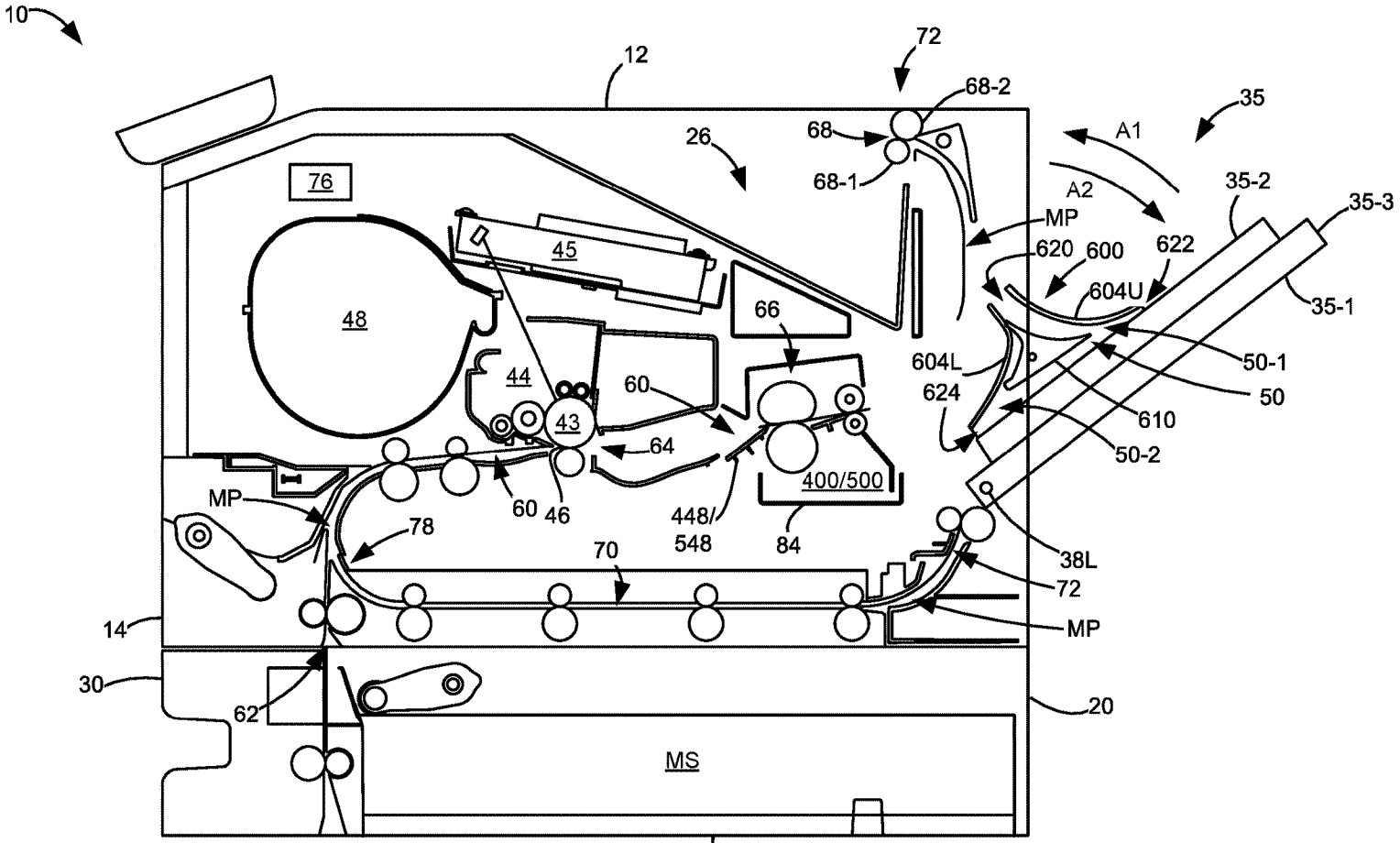

In FIGS. 2A and 2B, imaging device 10 is an electrophotographic imaging device that includes a laser scanning unit 45 which directs a laser beam to create a latent image on a charged photoconductive member 43 in an imaging unit 44. A toned image corresponding to the latent image is formed on photoconductive member 43 using toner supplied by a toner bottle 48. The toned image is transferred from photoconductive member 43 to a media sheet picked from a media stack MS at a transfer nip 46 formed by photoconductive member 43 and a backup roll 47 and through which the media sheet passes. The media sheet then moves through a removable fuser assembly whereupon the toner particles forming the toned image are fused to the media sheet by application of heat and/or pressure. In the present disclosure, the removable fuser assembly may either be of two types of fuser assembly—a first type or a hot roll fuser assembly 400 (see FIGS. 4A-4C) or a second type or a belt fuser assembly 500 (see FIGS. 5A-5C) which utilizes a heated roll and a belt as a fusing member, respectively. For a simplex or single-sided printing operation, the fused media sheet is then directed to media output area 26. Relative to the view provided by FIGS. 2A and 2B, the media path MP of the media sheet, as it is moved from media stack MS to media output area 26, has an inverted S-shape.

In FIGS. 2A and 2B, a simplex portion 60 of media path MP extends from an entrance 62 located adjacent to media tray 30 through an imaging area 64, a fusing area 66 where one of fuser assemblies 400 or 500 is disposed, and an exit nip 68 defined by a pair of redrive rolls 68-1, 68-2 positioned adjacent media output area 26 and top edge 35-3 of access door 35. A duplex path portion 70 of media path MP includes an entrance 72 adjacent bottom edge 35-4 of access door 35 and an exit 74 adjacent to and that merges with simplex portion 60 downstream of entrance 62. Depending on whether or not a simplex or a duplex printing operation is to be performed, redrive rolls 68-1, 68-2 either direct a fused media sheet to media output area 26 or through a media path channel 50 on access door 35 to duplex path portion 70 as will be discussed in detail below with respect to FIGS. 7A and 7B. In directing the fused media sheet to media output area 26 or duplex path portion 70, redrive rolls 68-1, 68-2 are rotated by a controller 76 of imaging device 10 in one of a first direction and a second direction opposite to the first direction.

FIG. 2A shows access door 35 in a raised closed position, while FIG. 2B shows access door 35 moved to the lowered open position. In FIG. 2B, access door 35 is movable towards a closed position as indicated by directional arrow A1 and towards an open position as indicated by directional arrow A2. When closed, as shown in FIG. 2A, access door 35 and deflector 600 complete media path MP for moving a media sheet as part of a printing operation. When open, as shown in FIG. 2B, access door 35 allows access to the interior of imaging device 10 moving deflector 600 away from fusing area 66. Fusing area 66, positioned adjacent access door 35, includes a receiving member or plate 84 (see FIG. 3) for receiving either fuser assembly 400 or fuser assembly 500 when installed in imaging device 10, as will be discussed with respect to FIG. 3. With access door 35 in the open position, fuser assembly 400 or 500 may either be moved into receiving member 84 for installation in fusing area 66 or removed therefrom by moving it toward access door 35.

Access door 35 and deflector 600 form parts of simplex and duplex path portions 60, 70 of media path MP in imaging device 10. Access door 35 also includes a media path channel 50 extending from top edge 35-3 to bottom edge 35-4 thereof forming a portion of both simplex and duplex path portions 60, 70. Referring still to FIGS. 2A and 2B, deflecting member or deflector 600 (also discussed further below with respect to at least FIG. 6B) is mounted along inner surface 35-2 of access door 35. Deflector 600 includes an entrance 620 in communication with corresponding rear exit portion of the installed fuser assembly, either fuser assembly 400 or 500 as the case may be, and first and second exits 622, 624—with first exit 622 in communication with media output area 26 and second exit 624 in communication with duplex path portion 70 (see FIGS. 7A and 7B). A pivotable diverter gate 610 is mounted in deflector 600 to direct a media sheet entering through entrance 620 to one of the two exits 622, 624. An upper portion 50-1 of media path channel 50 is in communication with first exit 622 and with media output area 26 and forms part of simplex portion 60, while a lower portion 50-2 of media path channel 50 is in communication with second exit 624 and entrance 72 of duplex path portion 70.

Figure 3:
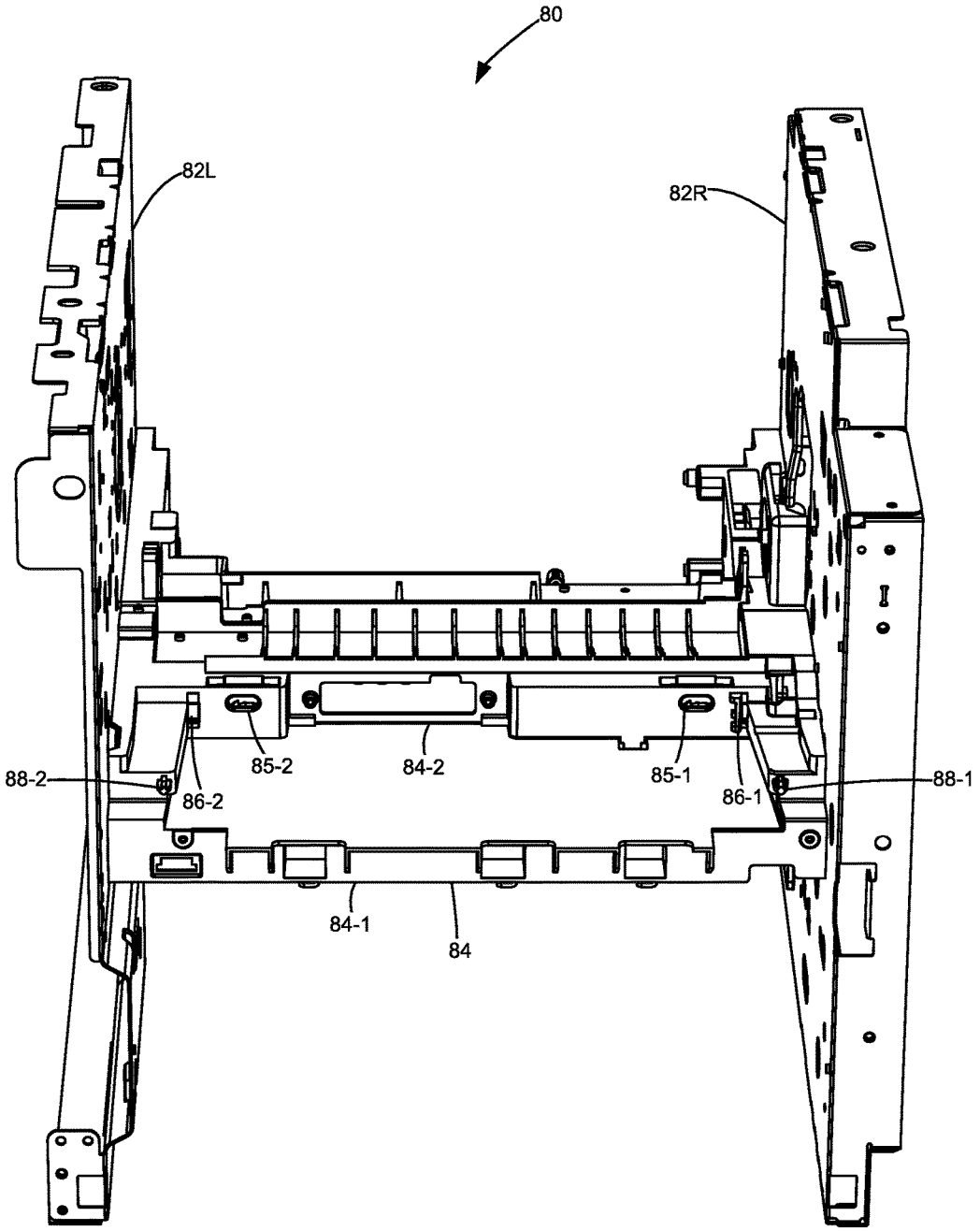
FIG. 3 is a perspective view of a frame for the imaging device in FIGS. 1A and 1B.

As shown in FIG. 3, frame 80 is used to support the internal components of imaging device 10 and includes at least left and right side panels 82L, 82R, respectively, as well as a front panel (not shown, for purposes of clarity). Receiving member 84 is attached to left and right side panels 82L, 82R. Receiving member 84 has a front side and a rear side 84-1, 84-2, respectively. A pair of spaced apart openings 85-1, 85-2, shown as horizontal slots 85-1, 85-2, is provided along rear side 84-2. Rear side 84-2 further includes a pair of mounting apertures 86-1, 86-2, shown as vertical apertures 86-1, 86-2, positioned outboard of slots 85-1, 85-2. A pair of alignment members 88-1, 88-2 are provided along right and left side panels 82R, 82L inboard of front side 84-1.

FIGS. 4A-4C and FIGS. 5A-5C show front perspective, rear perspective, and interior views, respectively, of hot roll fuser assembly 400 and belt fuser assembly 500. In the present disclosure, fuser assembly 500 includes substantially the same elements as that of fuser assembly 400, with the exception of a rotatable belt being used in belt fuser assembly 500 as one of a pair of fusing members forming a nip instead of a heated roll. While different fusing members are used, fuser assemblies 400 and 500 however are generally similar in structure. These similarities in structure with hot roll and belt fuser assembly types 400, 500 are such that they can be interchangeably mounted within imaging device 10.

Figure 4A:
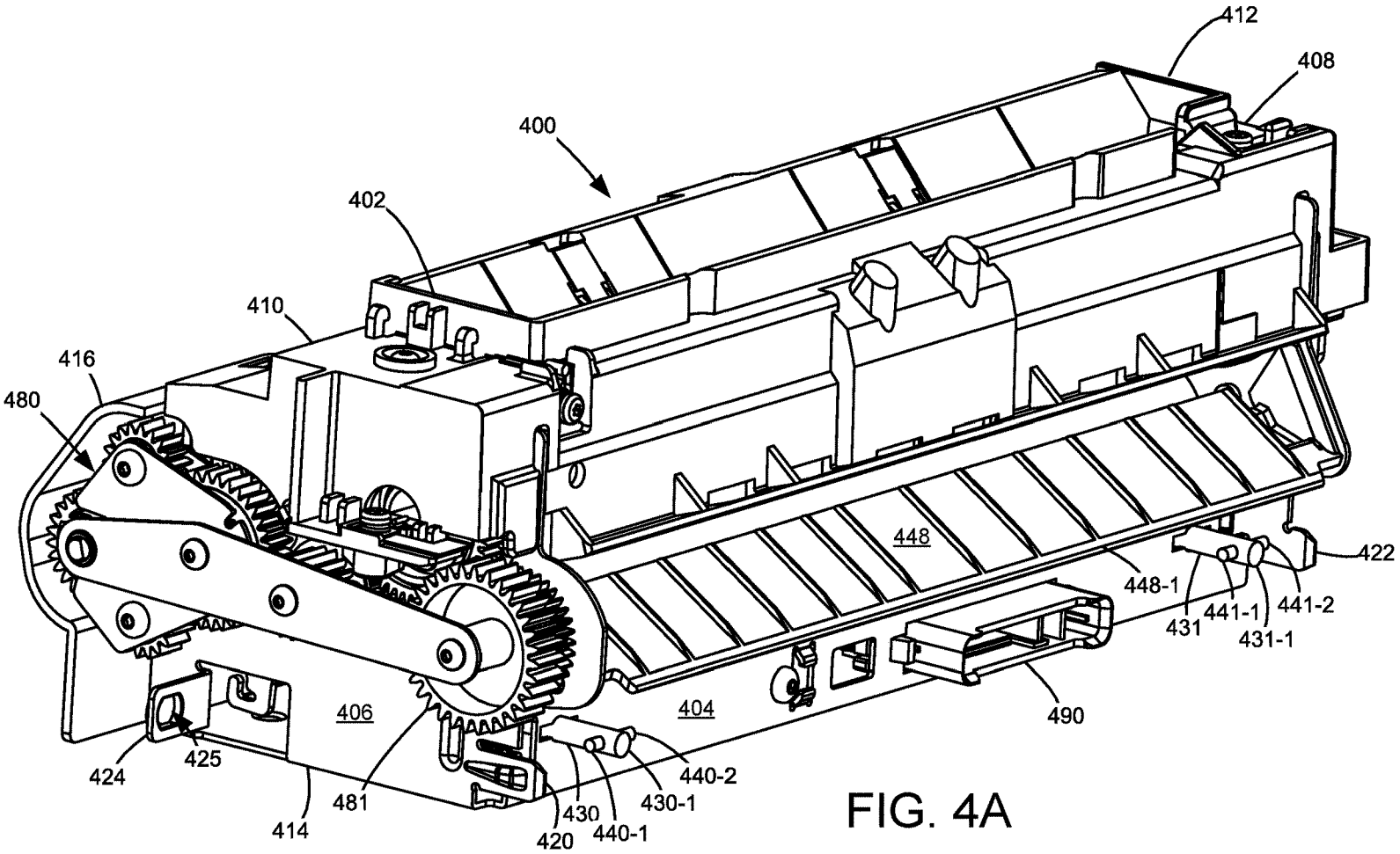
FIGS. 4A, 4B, and 4C are front and rear perspective views, and an interior view, respectively, of a hot roll fuser assembly for the imaging device in FIGS. 1A and 1B, according to an example embodiment.
Figure 4B:
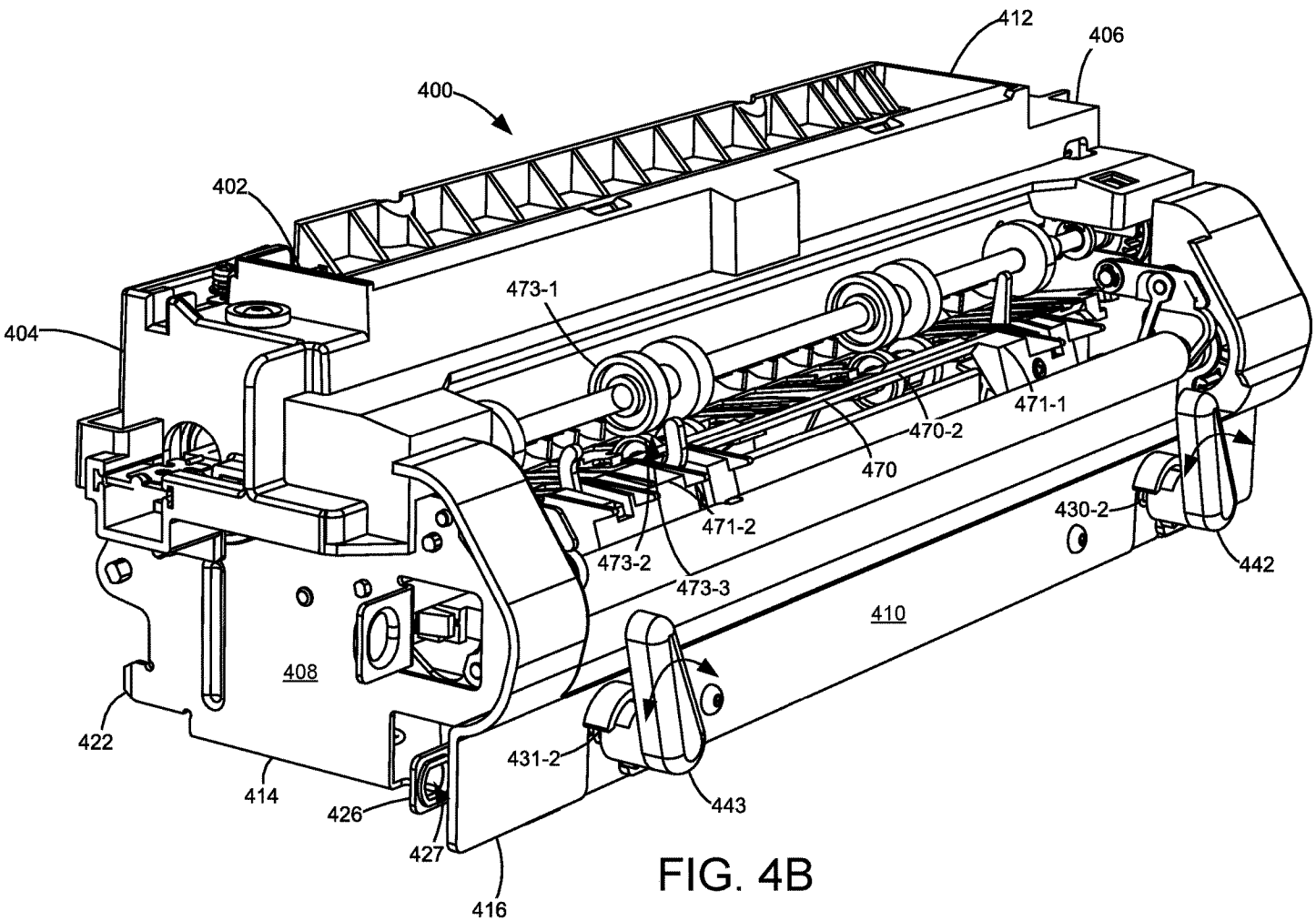
Figure 4C:
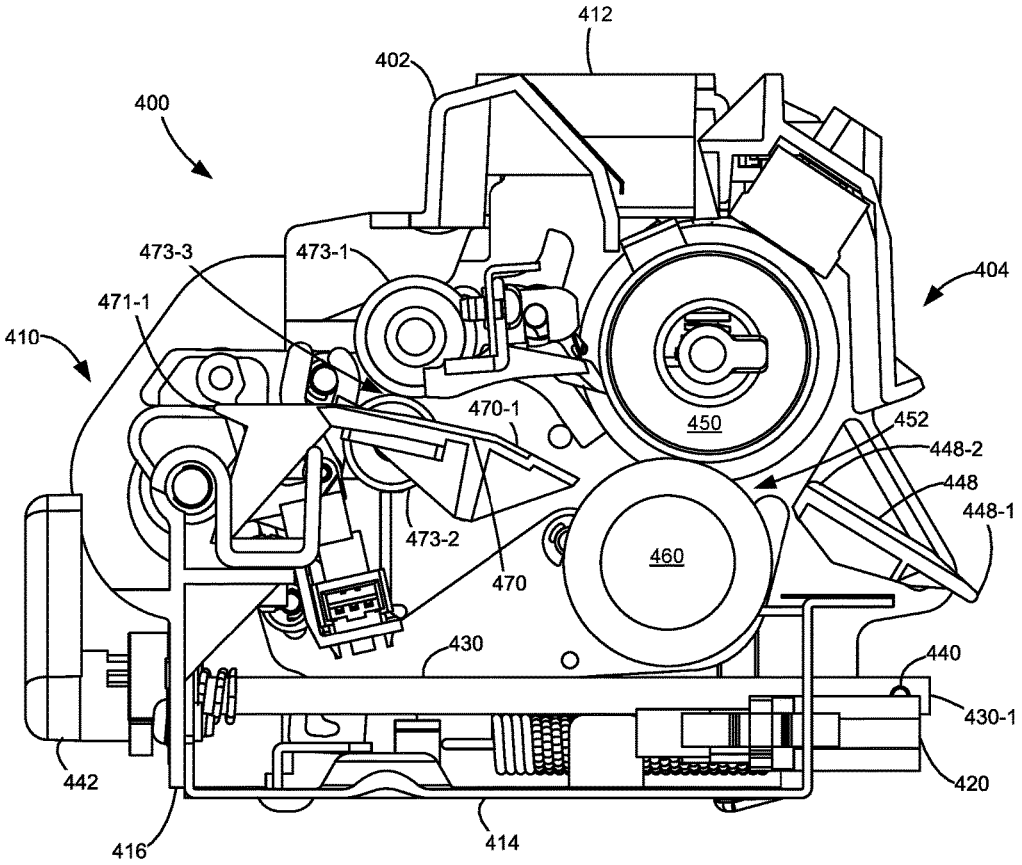

With reference to FIGS. 4A-4C, fuser assembly 400 includes a housing 402 having a front 404, a first and a second side 406 and 408, a rear 410, a top 412, and a bottom 414. A detachable rear cover 416 is provided on rear 410 of housing 402. As shown in FIGS. 4A and 4B, fuser assembly 400 includes a set of mounting features comprising a first pair of mounting datum tabs 420, 422 and a second pair of mounting datum tabs 424, 426. First pair of mounting datum tabs 420, 422 is disposed adjacent front 404 and extend outwardly from first and second sides 406, 408, respectively, (FIGS. 4A and 4B) in the insertion direction of fuser assembly 400 within imaging device 10. Second pair of mounting datum tabs 424, 426 is disposed adjacent rear 410 and extend generally orthogonally outwardly from, respectively, first and second sides 406, 408. Second pair of mounting datum tabs 424, 426 includes respective openings 425, 427. First pair of mounting datum tabs 420, 422 engage with mounting apertures 86-1, 86-2, respectively on frame 80 (FIG. 3). Openings 425, 427, of the second pair of mounting datum tabs 424, 426 engage with alignment members 88-1, 88-2, shown as cruciform posts, on frame 80 when fuser assembly 400 is mounted within imaging device 10.

FIG. 4C also shows a locking mechanism comprising a pair of mounting shafts 430, 431 extending along front 404 and rear 410. Each mounting shaft 430, 431 has a pin member 440, 441 at a first ends 430-1, 431-1 thereof and a handle 442, 443 at a second ends 430-2, 431-2 thereof, respectively. Pin members 440, 441 include respective pairs of aligned segments 440-1, 440-2, and 441-1, 441-2 orthogonally disposed about corresponding first ends 430-1, 431-1 of a corresponding mounting shafts 430, 431, as best shown in FIG. 4A. During installation of fuser assembly 400 into frame 80, pin members 440, 441 pass through slots 85-1, 85-2, respectively, provided in receiving member 84. With fuser assembly 400 installed on receiving member 84 of imaging device 10, handles 442, 443 may be pivoted in a first direction for rotating corresponding mounting shafts 430, 431 causing respective pin members 440, 441, to rotate from being aligned with openings 85-1, 85-2 to being substantially orthogonal thereto such that fuser assembly 400 is locked with receiving member 84 on frame 80. Accordingly, when handles 442, 443 are pivoted in a second direction opposite the first direction, corresponding mounting shafts 430, 431 are also rotated until pin members 440, 441 are realigned with corresponding openings 85-1, 85-2 thereby unlocking fuser assembly 400 and allowing it to be removed from frame 80 of imaging device 10.

As shown in FIGS. 4A and 4C, front 404 of fuser assembly 400 includes an angled entrance guide 448 for receiving a media sheet having a toned image along media path MP. Entrance guide 448 includes a first end 448-1 extending outwardly from front 404 of housing 402 for receiving the media sheet from media path MP and a second end 448-2 disposed adjacent a fusing nip 452 within fuser assembly 400. The media sheet then passes along entrance guide 448 to fusing nip 452 formed by a heated roll 450 and a backup member 460 for fusing the toned image thereon. Fuser assembly 400 also includes a media exit guide 470 having a first end portion 470-1 adjacent fusing nip 452 and a second end portion 470-2 positioned adjacent to deflector 600 when access door 35 is closed. As shown in FIG. 4B, second end portion 470-2 of media exit guide 470 includes a pair of spaced apart, media exit guide portions 471-1, 471-2 extending outwardly and in a cantilevered manner over rear cover 416 of housing 402 toward deflector 600. Following fusing, first end portion 470-1 receives a leading edge of the fused media sheet from fusing nip 452 and second end portion 470-2 and media guide portions 471-1, 471-2 guide the fused media sheet into deflector 600. At least one pair of exit rolls 473-1, 473-2 are disposed downstream of fusing nip 452 forming an exit nip 473-3 to direct the fused media sheet out of housing 402 through rear 410 and into deflector 600. Exit roll 473-2 is rotatably installed in media exit guide 470 while exit roll 473-1 is rotatably installed in housing 402.

Figure 5A:
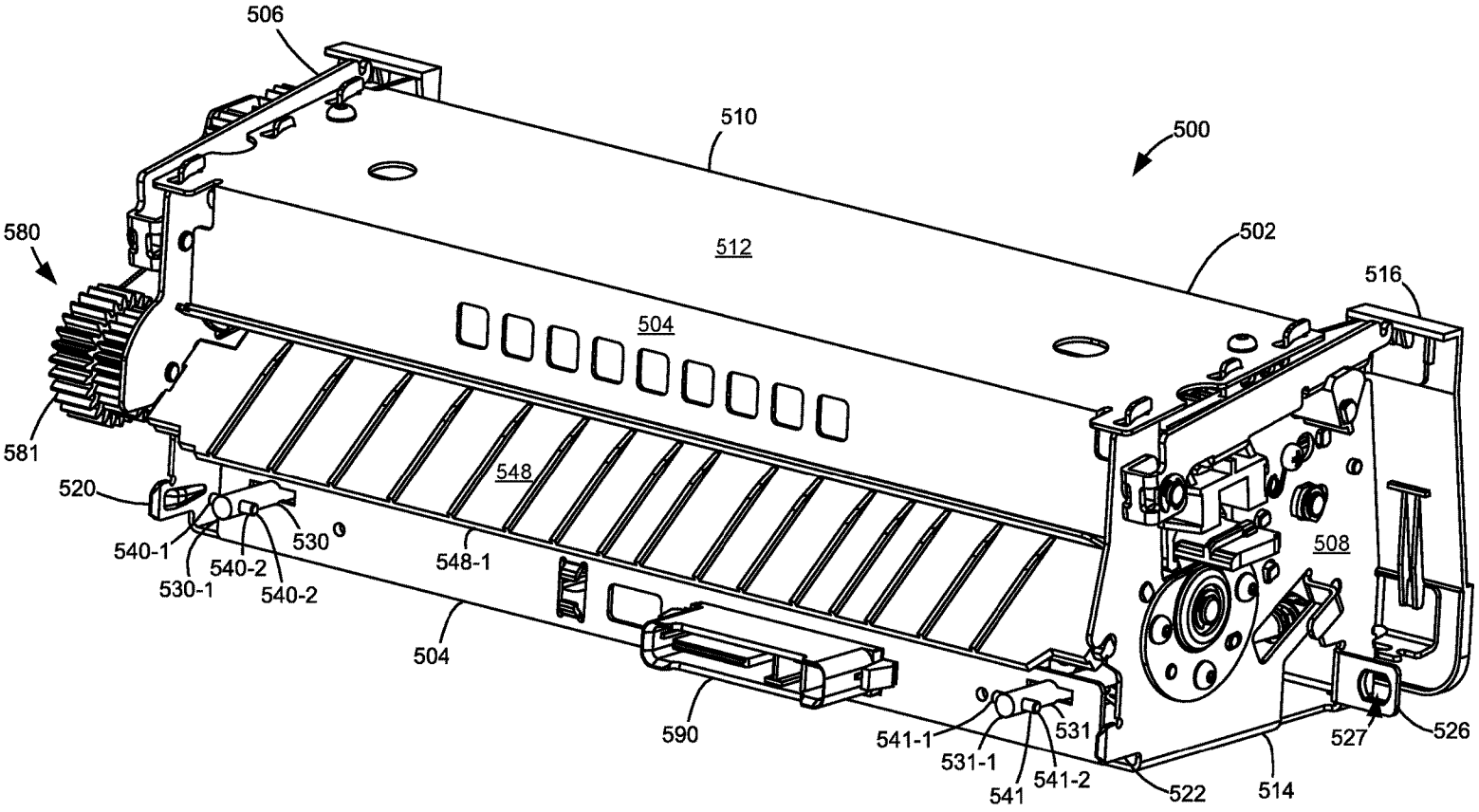
FIGS. 5A, 5B, and 5C are front and rear perspective views, and an interior view, respectively, of a belt fuser assembly for the imaging device in FIGS. 1A and 1B, according to an example embodiment.
Figure 5B:
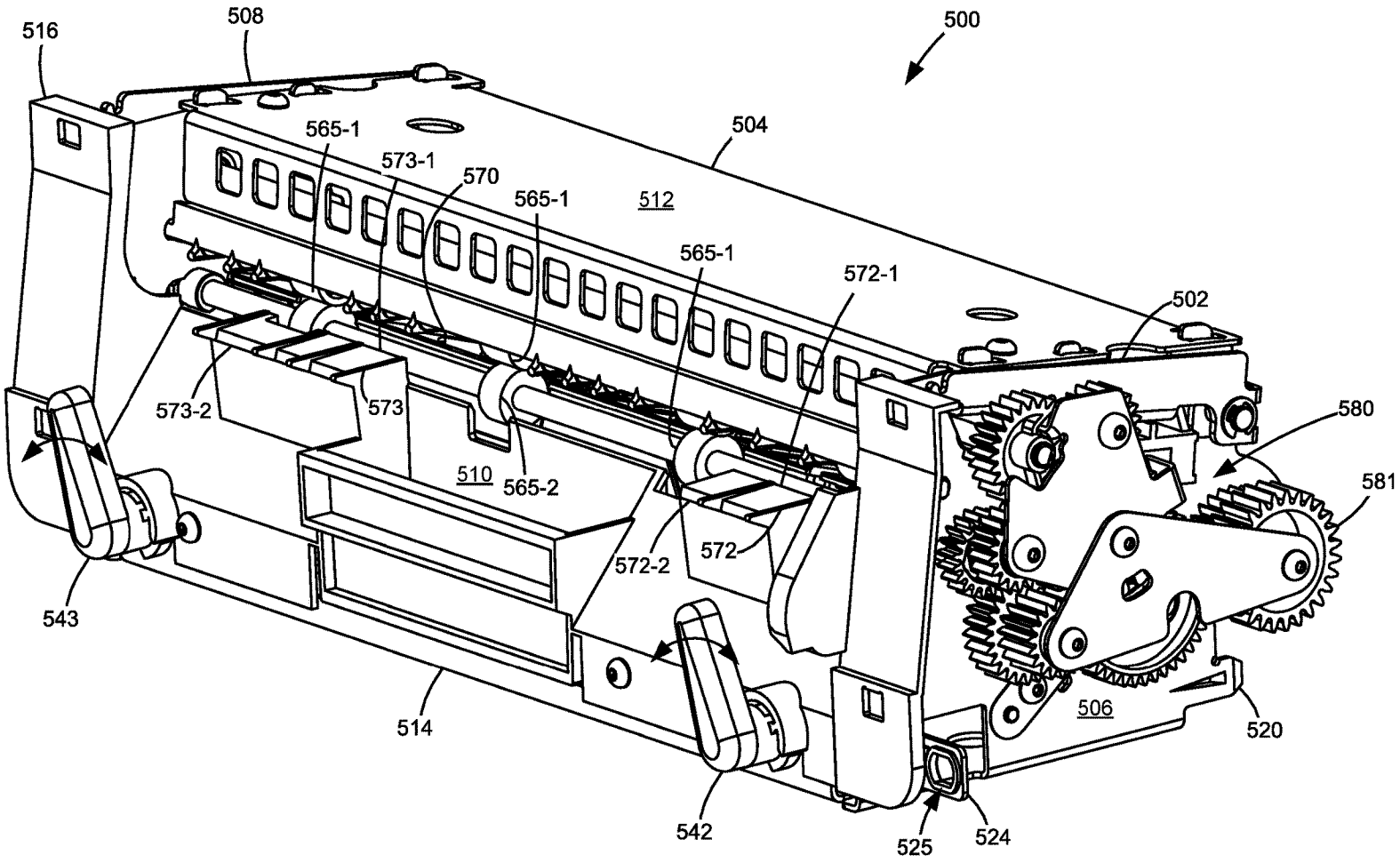
Figure 5C:
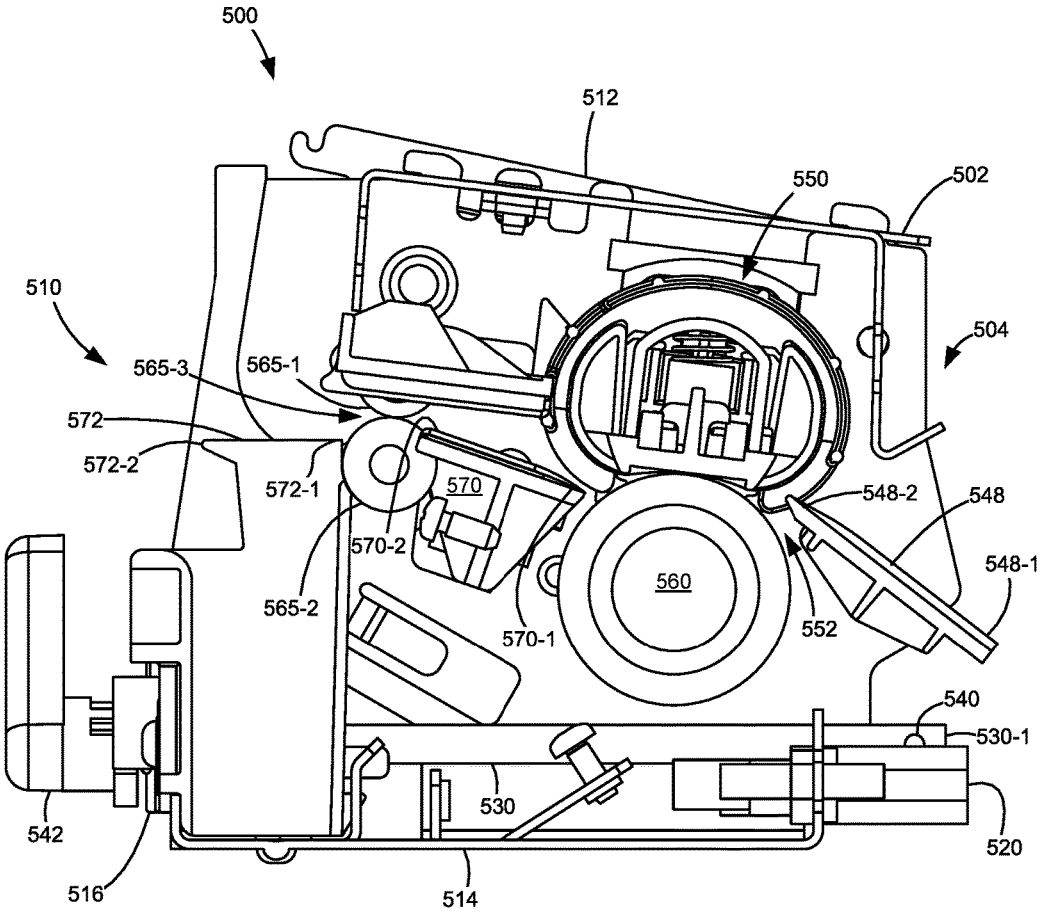

In FIGS. 5A-5C, fuser assembly 500 includes a housing 502 having a front 504, a first and a second side 506 and 508, a rear 510, a top 512, and a bottom 514. A detachable rear cover 516 is provided on rear 510 of housing 502. In the present disclosure, fuser assembly 500 includes a set of mounting features and a locking mechanism substantially the same with respect to the mounting features and locking mechanism of fuser assembly 400 of FIGS. 4A-4C. For fuser assembly 500 the set of mounting features comprise a first pair of mounting datum tabs 520, 522 and a second pair of mounting datum tabs 524, 526 oriented in the same manner on fuser assembly 500 as datum tabs 420, 422 and 424, 426 of fuser assembly 400. Second pair of mounting datum tabs 524, 526 further includes respective openings 525, 527. Fuser assembly 500 also includes a locking mechanism including a pair of mounting shafts 530, 531 each having respective pin members 540, 541 on respective first ends 530-1, 531-1 thereof. Handles 542, 543 are provided along second ends 530-2, 531-2 of shafts 530, 531, respectively. Pin members 540, 541 each includes a pair of segments 540-1, 540-2 and 541-1, 541-2 disposed on shafts 530, 531, respectively, in a similar manner as described previously for pin members 440, 441. Handles 542, 543 are also rotatable between a first and a second position for locking and unlocking fuser assembly 500 with respect to frame 80. Where fuser assembly 500 is mounted onto frame 80, first and second pair of mounting datum tabs 520, 522 and 524, 526 interface with mounting apertures 85-1, 85-2 and alignment members 88-1, 88-2 on frame 80, respectively.

As shown in FIGS. 5A and 5C, front 504 of fuser assembly 500 includes an angled entrance guide 548 for receiving a media sheet having a toned image along media path MP. Entrance guide 548 also includes a first end 548-1 extending outwardly and downwardly from front 504 of housing 502 for receiving the media sheet from media path MP and a second end 548-2 disposed adjacent a fusing nip 552 within fuser assembly 500. With fuser assembly 500 mounted on imaging device 10, the media sheet passes along entrance guide 548 to fusing nip 552 formed by a rotatable belt 550 and a backup member 560 for fusing the toned image thereon.

With reference to FIG. 5B, at least one pair of exit rolls 565-1, 565-2 are disposed adjacent fusing nip 552 and form an exit nip 565-3 for directing the fused media sheet out of housing 502 through rear 510 and into deflector 600. With reference to FIG. 5C, fuser assembly 500 includes a first media exit guide 570 positioned between belt 550 and backup member 560 and exit rolls 565-1, 565-2. First media exit guide 570 has a first end portion 570-1 adjacent fusing nip 552 and a second end portion 570-2 adjacent exit nip 565-3. As shown in FIGS. 5B, 5C and 9B, fuser assembly 500 further includes a pair of spaced apart second media exit guides 572, 573 provided on rear cover 516 downstream of exit nip 565-3. Pair of second media exit guides 572, 573 includes respective first ends 572-1, 573-1 adjacent exit roll 565-2 and second ends 572-2, 573-2 downstream thereof and adjacent to deflector 600 when access door 35 is closed. Second ends 572-2, 573-2 include portions that are cantilevered outwardly from rear 510 of housing 502 toward deflector 600.

For both fuser assemblies 400, 500, an exit sensor (not shown) as is known in the art may be positioned at a location along the media path MP upstream of media exit guides 470 and 572, 573 to detect fused media sheets as it leaves respective fusing nips of fuser assemblies 400 and 500. As shown in FIGS. 4A and 5B, fuser assemblies 400, 500 also include respective drive trains 480, 580 positioned on respective sides 406, 506 thereof for driving the respective fusing components of fuser assemblies 400, 500. When either of fuser assemblies 400 or 500 is in its operable position within imaging device 10, gears 481, 581 in drive trains 480, 580 rotatably engage with a machine gear and drive motor (not shown) on imaging device 10. Electrical connectors 490 and 590 for establishing electrical connections with controller 76 (FIGS. 2A and 2B) and a power supply (not shown) of imaging device 10 are also positioned along respective fronts 404, 504 of fuser assemblies 400, 500.

Figure 6A:
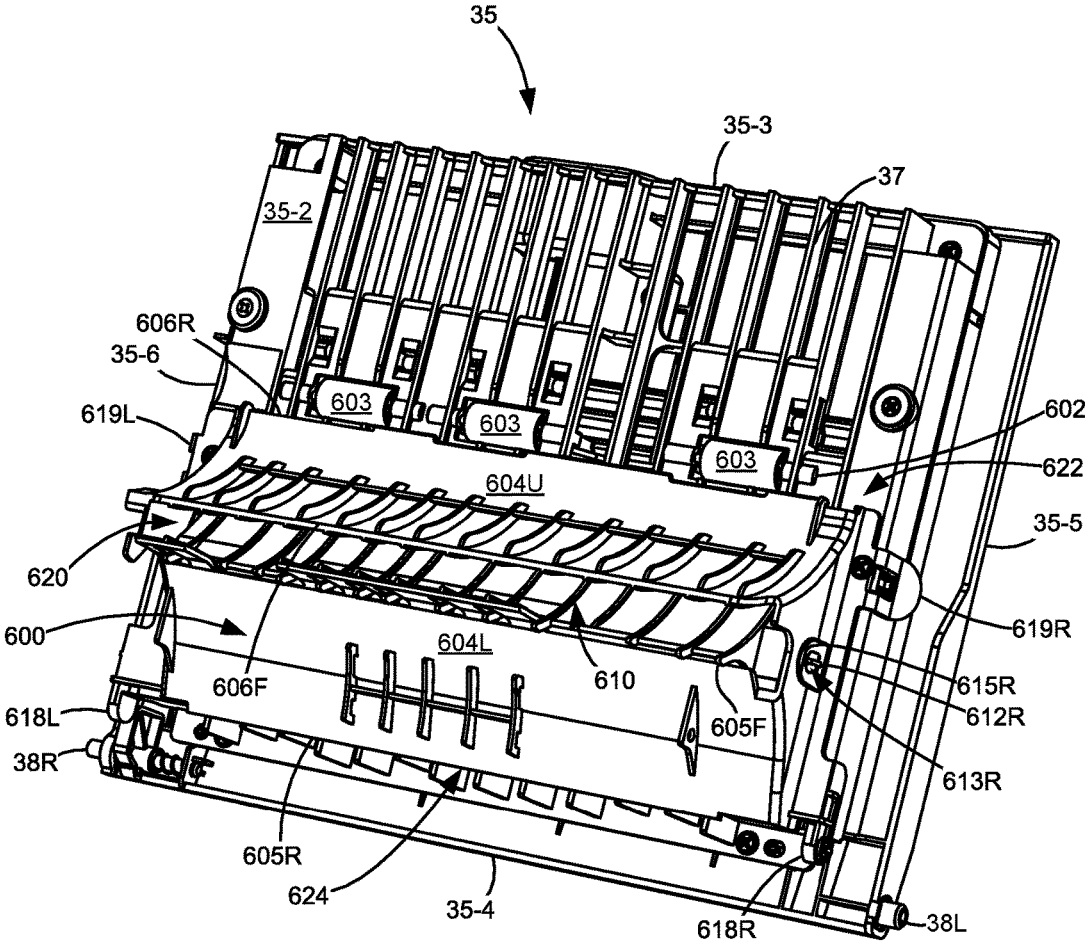
FIGS. 6A and 6B are a side perspective view and an exploded view, respectively, of the imaging device access door shown in FIGS. 1A and 1B.
Figure 6B:
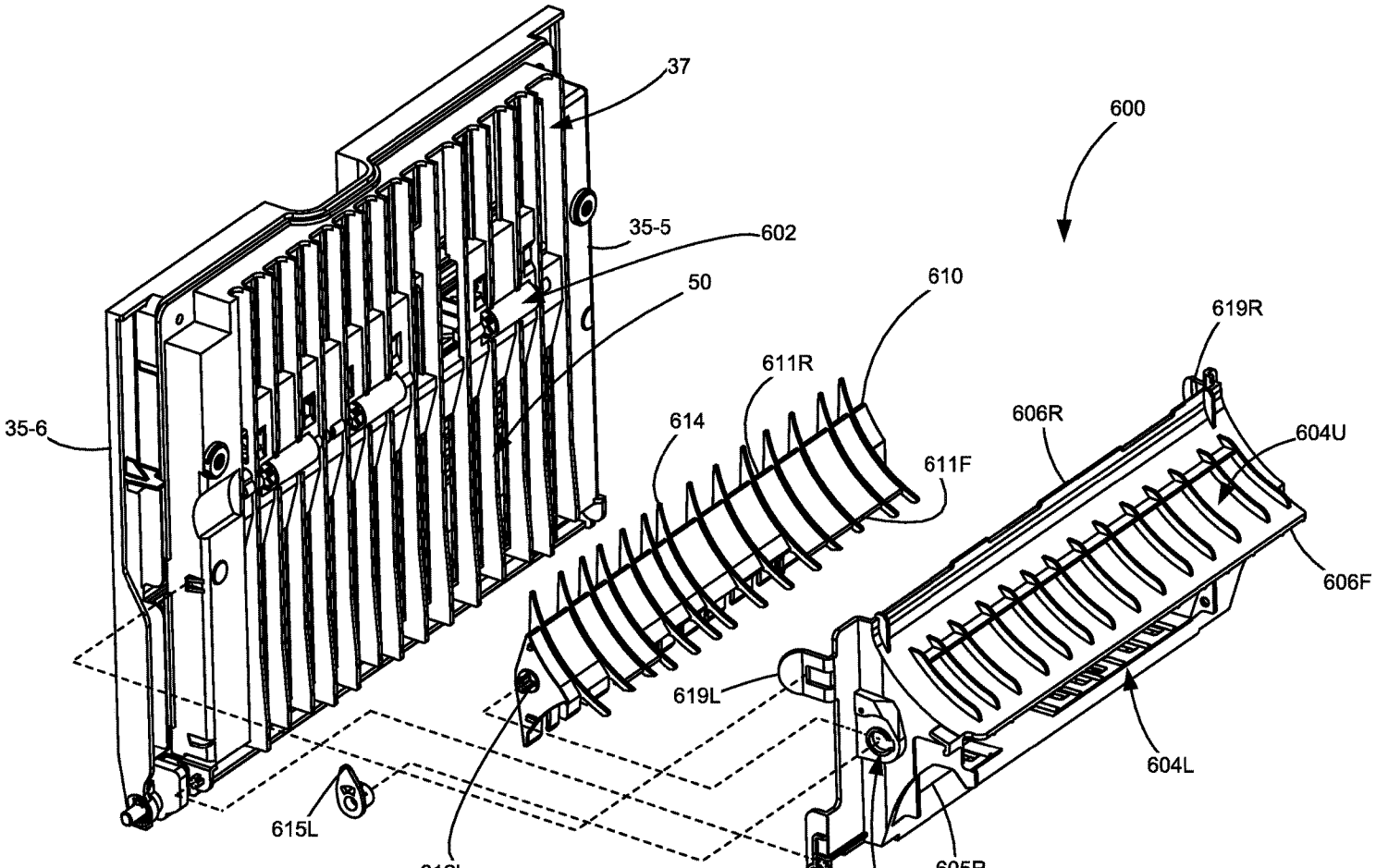

As shown in FIGS. 6A and 6B, door 35 includes media path channel 50 between inner surface 35-2 which extends from top edge 35-3 and bottom edge 35-4 thereof and deflector 600. Inner surface 35-2 includes a plurality of parallel guide ribs 37 that form a rear surface of media path channel 50. An exit roll 602 having a plurality of rolls 603 is shown rotatably mounted on inner surface 35-2 for moving the fused media sheet to exit rolls 68-1, 68-2 where the fused media is directed either to media output area 26 or to duplex path portion 70. Deflector 600 of door 35 also includes a pair of upper and lower media guide members 604U, 604L mounted across the media path on inner surface 35-2 of door 35 adjacent to bottom edge 35-4.

In FIGS. 6A and 6B, lower and upper media guide members 604L, 604U extend in a downward and in an upward arching manner, respectively, as viewed from entrance 620, and are spaced apart at their respective front ends 605F, 606F, forming entrance 620 of deflector 600. The respective rear ends 605R, 606R of lower and upper media guide members 604L, 604U are spaced from inner surface 35-2 forming first and second exits 622, 624, respectively, of deflector 600. In the present disclosure, upper and lower media guide members 604U, 604L are depicted as a unitary member attached onto inner surface 35-2 of door 35. However in other example embodiments, upper and lower media guide members 604U, 604L may be separate members coupled to form entrance 620 and first and second exits 622, 624.

Deflector 600 further includes diverter gate 610 pivotally mounted within and between upper and lower media guide members 604U, 604L for directing media sheets passing through entrance 620 between first and second exits 622, 624. Gate 610 includes a curved planar front surface 611F and a straight planar rear surface 611R each having a plurality of media guide ribs 614 spaced across the width of gate 610. Pivot mounts 612R, 612L are provided on right and left ends of gate 610. Pivot mounts 612R, 612L are received in aligned openings 613R, 613L provided on the right and left sides of deflector 600 and attached thereon via fasteners 615R, 615L, respectively. Deflector 600 is also coupled to inner surface 35-2 of access door 35 via fasteners, such as posts 618R, 618L, and tabs 619R, 619L provided on the right and left sides of deflector 600.

Figure 7B:
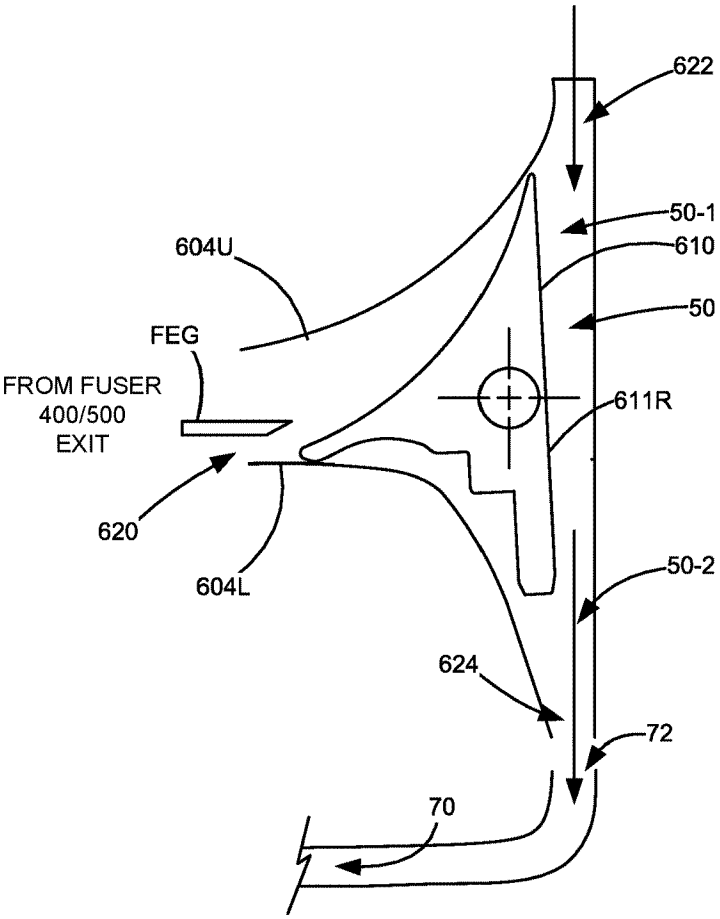
FIGS. 7A and 7B are schematic diagrams illustrating movement of a diverter gate of the deflector in the first position to direct media to an output area and in the second position to direct media to a duplex portion of the media path, respectively.
Figure 7A:
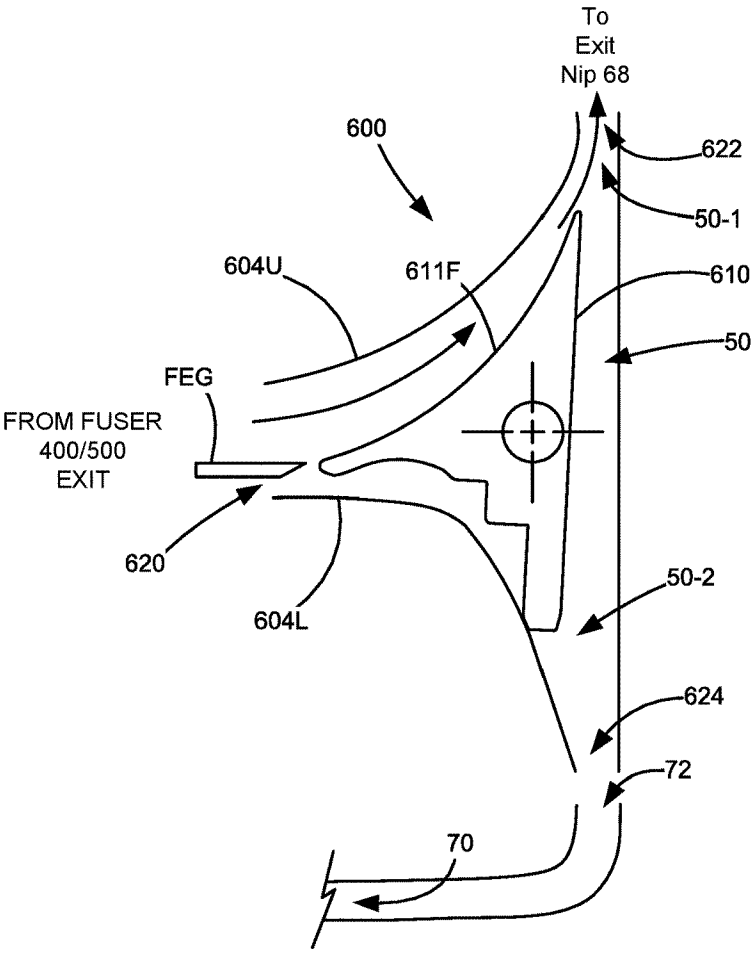

FIGS. 7A and 7B schematically depict gate 610 in the first position and in the second position, respectively, relative to entrance 620 on deflector 600 as viewed from FIGS. 2A and 2B. Entrance 620 of deflector 600 is in communication with media exit guides 470 and 572, 573 and corresponding rear portions 410, 510 of fuser assemblies 400, 500 depending upon which one is mounted in imaging device 10. The exit guides for fuser assemblies 400 and 500 are generally designated as FEG in these two figures. Entrance 620 receives fused media exiting the installed fuser assembly. As discussed above with respect to FIGS. 2A and 2B, deflector 600 has first exit 622 for directing the fused media to media output area 26 and second exit 624 for when a duplex printing operation is required.

In FIG. 7A, regardless of whether or not controller 76 has determined that a simplex or duplex printing operation is to be performed, following performing a fusing operation, gate 610 is initially pivoted in the first position. The fused media sheet entering entrance 620 strikes front surface 611F of gate 610 directing the fused media sheet to and out of first exit 622 into exit nip 68 of redrive rolls 68-1, 68-2. When it is determined that a simplex printing operation is to be performed, the fused media sheet is then outputted by redrive rolls 68-1, 68-2 onto media output area 26. When it is determined by controller 76 that a duplex printing operation is to be performed, rotation of redrive rolls 68-1, 68-2 continue to feed the fused media sheet toward media output area 26 until a trailing edge of the fused media sheet is beyond gate 610, then gate 610 is pivoted by controller 76 to its second position and redrive rolls 68-1, 68-2 are reversed for directing the fused media sheet past rear surface 611R of gate 610, through media path channel 50 and out second exit 624 and into duplex path portion 70 as shown in FIG. 7B. As will be appreciated by one of ordinary skill in the art, redrive rolls 68-1, 68-2 and deflector 600 form a peek-a-boo type duplexer.

Figure 8B:
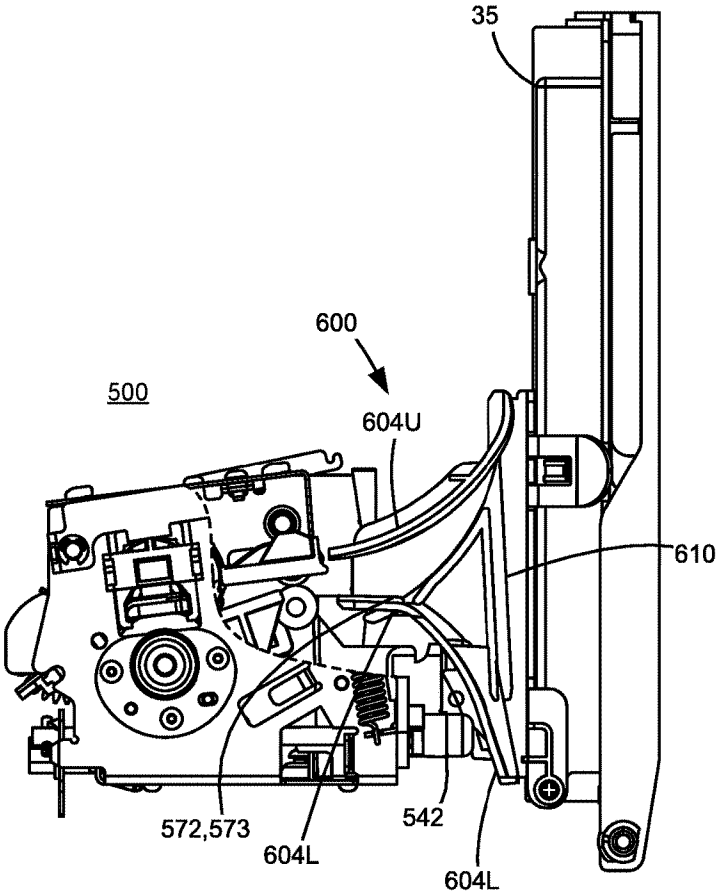
FIGS. 8A and 8B are side views of the deflector mounted on access door shown in FIG. 6A engaging with, respectively, the hot roll fuser assembly in FIGS. 4A-4C and the belt fuser assembly in FIGS. 5A-5C.
Figure 8A:
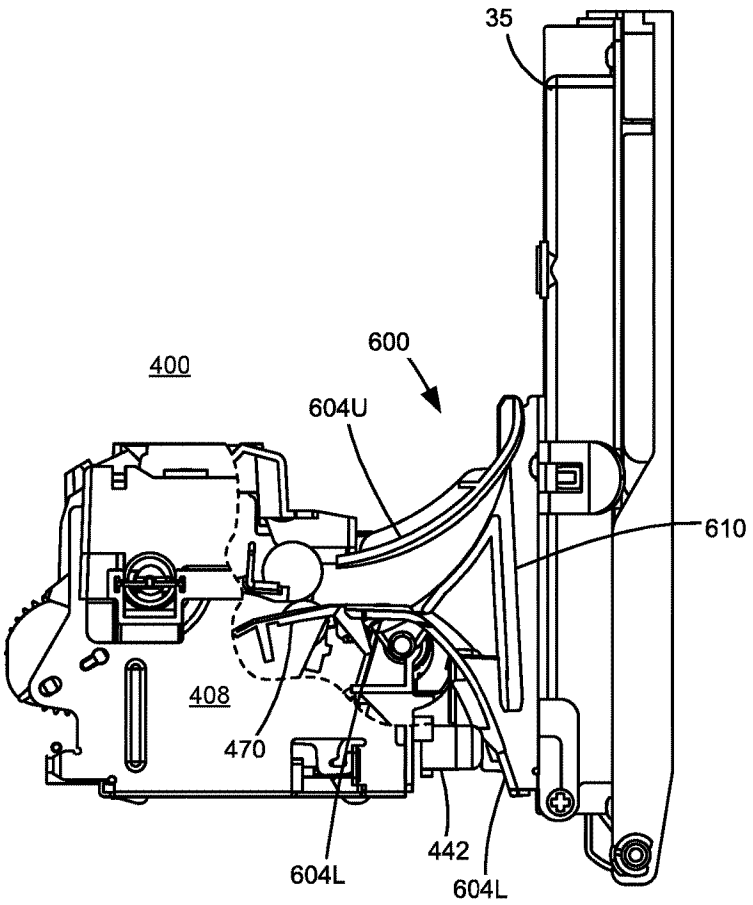

FIGS. 8A and 8B are partially cutaway side views of deflector 600 mounted on access door 35 interfacing with, respectively, fuser assembly 400 from FIGS. 4A-4C and fuser assembly 500 from FIGS. 5A-5C. Gate 610 is shown in its second position. For purposes of clarity, fuser assemblies 400, 500, deflector 600, and access door 35 are taken out of imaging device 10 but it is understood that either of fuser assemblies 400, 500 are mounted on receiving member 84 of fusing area 66 adjacent to access door 35 in its closed position, as shown in FIG. 2A. In FIG. 8A, lower media guide member 604L of deflector 600 is shown interfacing with media exit guide 470 of hot roll fuser assembly 400. In FIG. 8B, lower media guide member 604L is shown interfacing with media exit guides 572, 573 of belt fuser assembly 500. With lower guide member 604L of deflector 600 being interchangeably coupled with corresponding media exit guides of either fuser assemblies 400 or 500, deflector 600 on access door 35 is operative to interface with either fuser assembly 400 or 500 when one of which is mounted in the imaging device allowing a common redrive system to be used for both types of fuser assemblies.

Figure 9A:
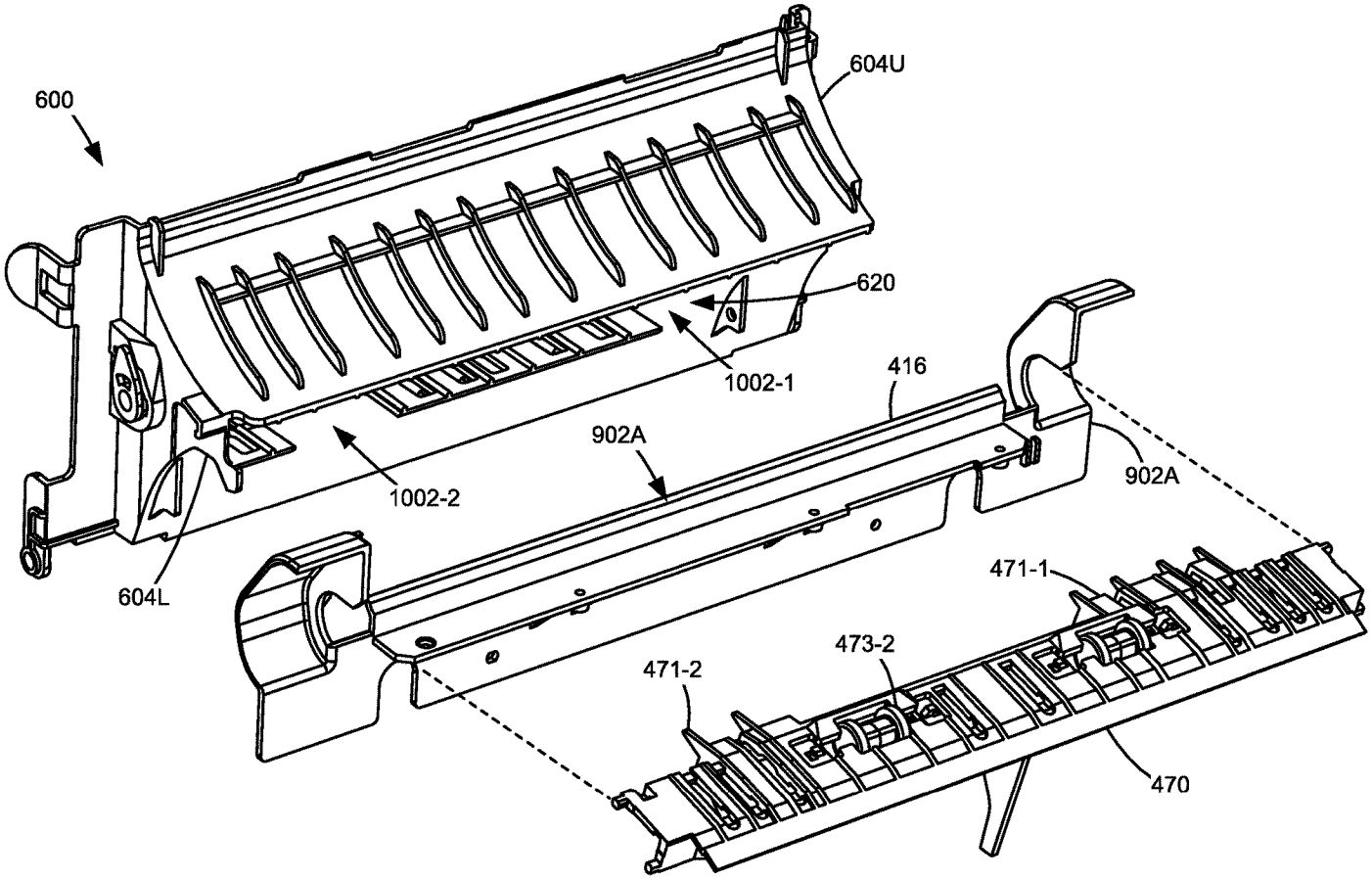
FIGS. 9A and 9B are exploded views of a deflector on the access door of FIGS. 6A and 6B engaging with, respectively, a rear cover and media exit guide portion of the hot roll fuser assembly in FIGS. 4A-4C and a rear cover and media exit guide portion of the belt fuser assembly in FIGS. 5A-5C.
Figure 9B:
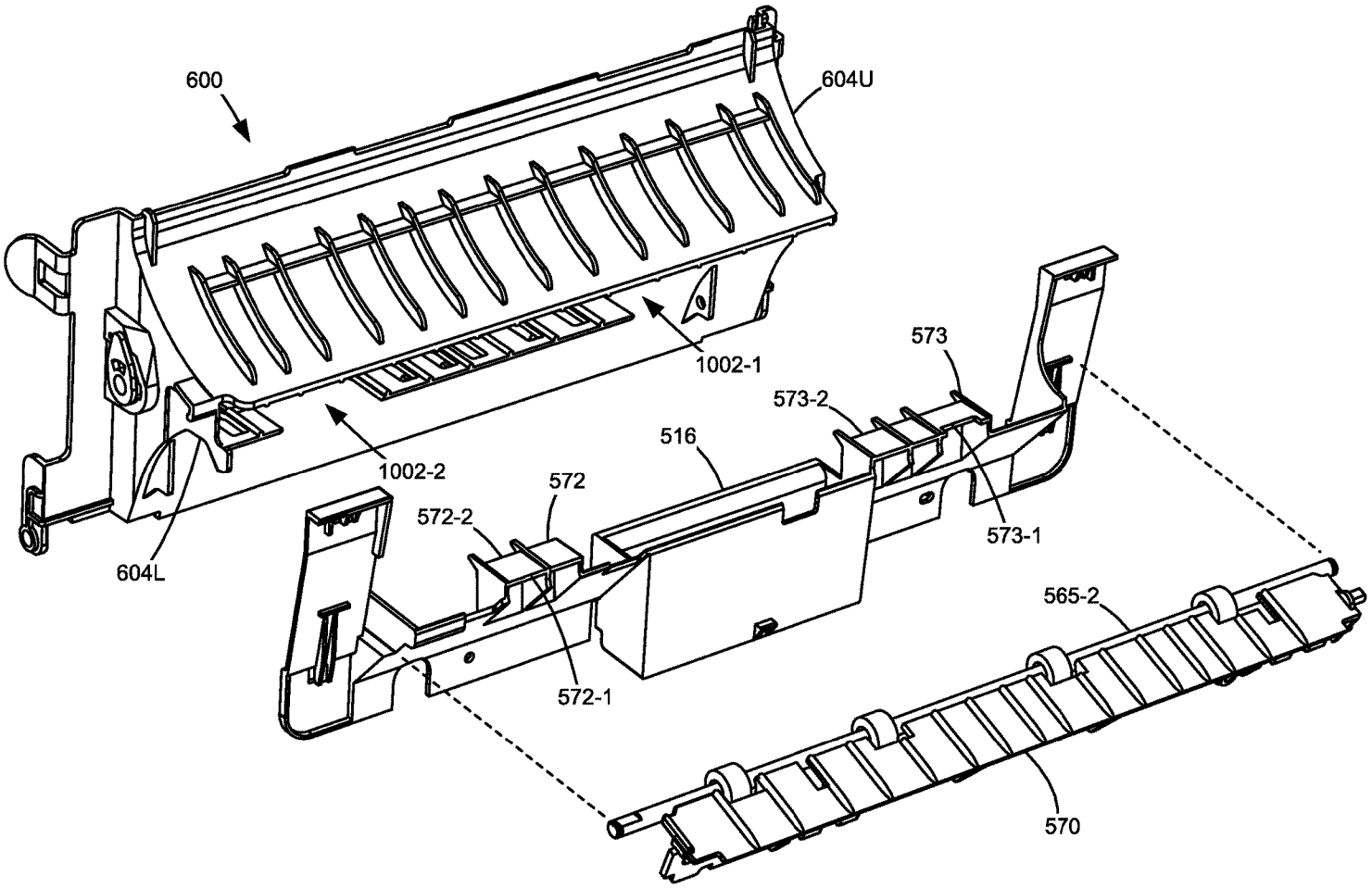

FIGS. 9A and 9B are exploded views of the upper and lower media guides 604U, 604L of deflector 600 in FIGS. 6A and 6B engaging with, respectively, rear covers 416, 516 and rear media exit guides 470 and 572, 573, of fuser assemblies 400, 500 shown in FIGS. 4A-4C and FIGS. 5A-5C, respectively. The reminder of fuser assemblies 400, 500 are not shown for purposes of clarity. FIG. 9A shows upper and lower media guide 604U, 604L of deflector 600, and rear cover 416 and media exit guide 470 of fuser assembly 400 (from FIG. 4B). FIG. 9B shows upper and lower media guides 604U, 604L of deflector 600, rear cover 516 with pair of second media exit guides 572, 573, and first media exit guide 570 (from FIG. 5B). Rear covers 416, 516 are attached to respective housings 402, 502 of fuser assemblies 400, 500 and are adjacent to and downstream of media exit guides 470, 570. Rear covers 416, 516 interface with deflector 600 when access door 35 is in the raised closed position. In the present disclosure, deflector 600 includes a pair of cutouts 1002-1, 1002-2 along a length of lower media guide members 604L. Cutout 1002-1 is sized to receive either media exit guide portions 471-1 or 573 while cutout 1002-2 is sized to receive and accommodate media exit guide portions 471-2 or 572.

Figure 10A:
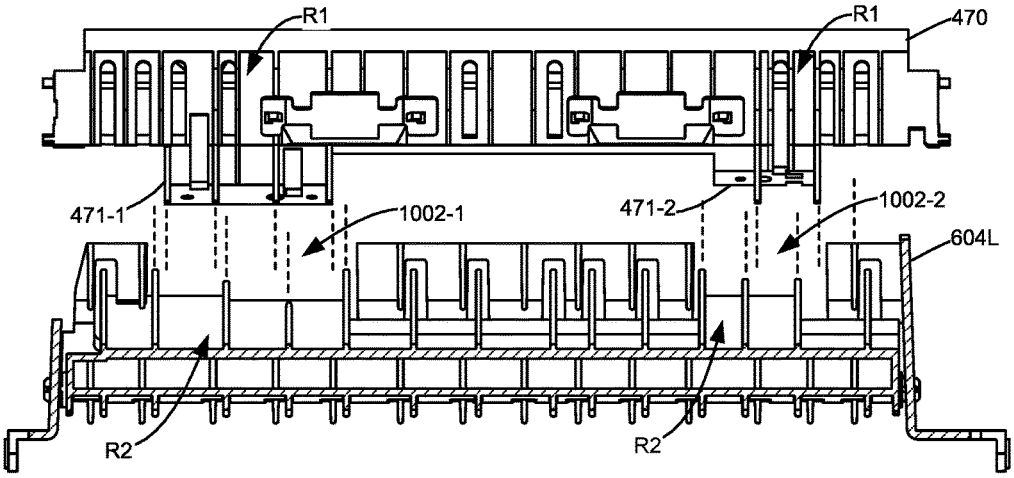
FIGS. 10A and 10B are top views showing the interface, respectively, between the deflector of FIGS. 9A and 9B and the media exit guides of the hot roll fuser assembly in FIGS. 4A-4C, and between the same deflector and the media exit guides of the belt fuser assembly in FIGS. 5A-5C.
Figure 10B:
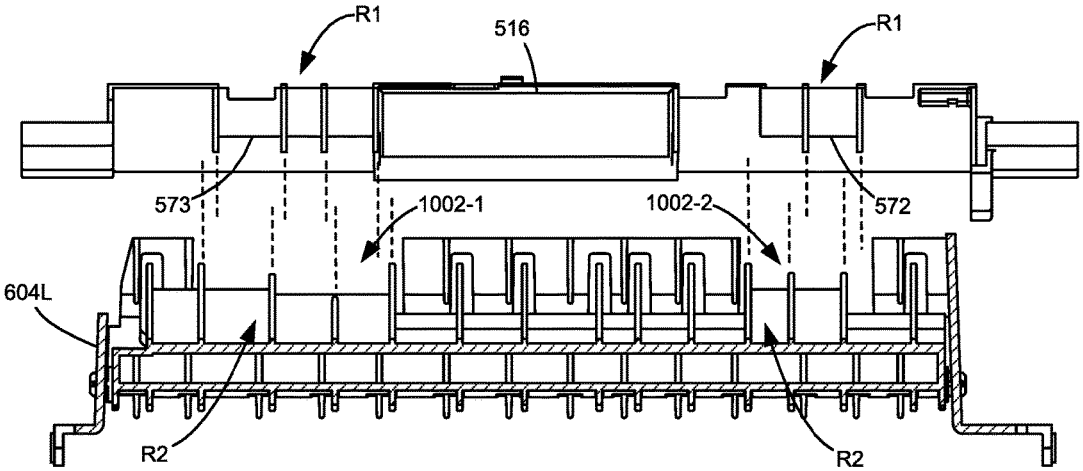

FIG. 10A is a top view showing the interface between lower media guide member 604L of deflector 600 and media exit guide 470 of fuser assembly 400. FIG. 10B is a top view showing the interface between lower media guide member 604L of deflector 600 and media exit guides 572, 573 on rear cover 516 of fuser assembly 500. Media exit guide portions 471-1, 471-2 and media exit guide portions 572, 573 on rear cover 516 are disposed at predetermined positions along a length of media exit guide 470 and rear cover 516, respectively. When access door 35 is in the raised closed position, media exit guides 471-1, 471-2 and 573, 572 are received in cutouts 1002-1, 1002-2 on lower media guide member 604L of deflector 600. The surfaces of media exit guide portions 471-1, 471-2 and 572, 573 and the surface of lower media guide member 604L include respective pluralities of ribs R1, R2. When access door 35 is in the raised closed position and deflector 600 interfaces with rear covers 416, 516, these respective pluralities of ribs R1, R2 interleave or are offset from one another as indicated by the dashed lines in FIGS. 10A-10B. This enables smooth transition from the fuser to the media redrive system. Cutouts 1002-1, 1002-2 are illustrated as having different widths however these cutouts may have the same width and this a matter of design choice.

Figure 11:
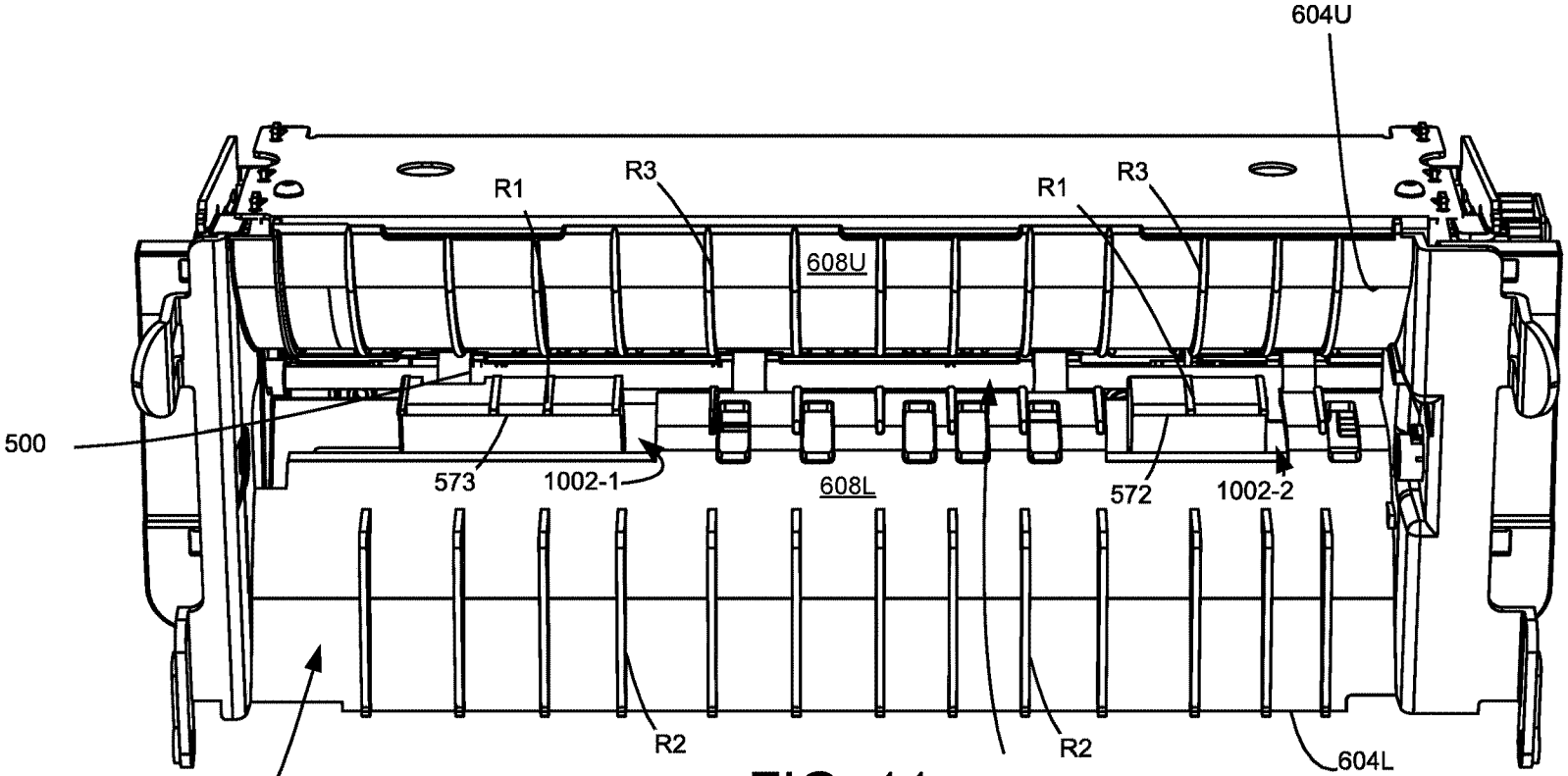
FIG. 11 is a back perspective view of the deflector of FIGS. 9A and 9B engaging with the media exit guides of the belt fuser assembly in FIGS. 5A-5C.

FIG. 11 shows a perspective view of the upper and lower media guides 604U, 604L of deflector 600 looking from the interior toward entrance 620 when engaging with rear cover 516 of fuser assembly 500. Gate 610 has been removed in FIG. 11 for purposes of clarity. Inner surfaces 608U, 608L of upper and lower media guide members 604U, 604L include pluralities of ribs R3, R2, respectively, that are offset relative to the plurality of ribs R1 found on media exit guides 572, 573 to ensure proper transition or handoff of the fused media sheet through entrance 620 of deflector 600. In having ribs R3 along inner surface 608U of upper media guide member 604U, a fused media sheet having upward leading edge angle is transitioned smoothly from entrance 620 and along first exit 622 as directed by gate 610. Similarly, in having ribs R2 along inner surface 608L of lower media guide member 604L, a fused media sheet having a downward leading edge angle is transitioned smoothly from entrance 620 and along toward first exit 622 as directed by gate 610.

Following fusing and passing through the exit nips, fused media sheets are directed by media exit guide portions 471-1, 471-2 or media exit guide portions 572, 573 into deflector 600 and ultimately towards their respective destinations in imaging device 10 as set by a user on user interface 28 (FIG. 1A). As such, having post-fusing interfaces common between fuser assemblies 400, 500 for interfacing with deflector 600 and access door 35 on imaging device 10 allows for a common media redrive system to be used for both types of fuser assemblies.

The description of the details of the example embodiments have been described in the context of a monochrome electrophotographic imaging devices. However, it will be appreciated that the teachings and concepts provided herein are applicable to color electrophotographic imaging devices and multifunction products employing electrophotographic imaging.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. An imaging device, comprising:

a removable fuser assembly installable along a portion of a media path in the imaging device, the fuser assembly being one of a hot roll fuser assembly and belt fuser assembly, the fuser assembly including:

a housing having at least a top, a bottom, and a front and a rear portion, the front and rear portions having respective openings for a media sheet to pass therethrough; and a first and a second rotating fusing member disposed within the housing for fusing a toned image onto the media sheet; and a media redrive system including:

an access door pivotally mounted along the imaging device and movable between a raised closed position and a lowered open position, the access door having an outer and an inner surface relative to a frame of the imaging device, and a media path channel along a length of the access door; and a deflector interfaceable with the fuser assembly, the deflector including:

an upper and a lower media guide member mounted on the inner side of the access door over a portion of the media path channel with a lower end of the upper media guide member and an upper end of the lower media guide member forming an entrance therebetween for receiving the media sheet from the rear portion of the fuser assembly and the upper end of the upper media guide member and the inner side of the access door forming a first exit, and the lower end of the lower media guide member and the inner side of the access door forming a second exit; and a gate positioned adjacent the entrance formed by the upper and lower media guide members, the gate movable between a first position for directing the media sheet to the first exit and onto a media output area in the imaging device and a second position for directing the media sheet to the second exit along a downstream portion of the media path channel and into a duplex path portion of the imaging device for printing on an opposite side of the media sheet, wherein the fuser assembly further comprises a pair of media exit guide portions cantilevered along the rear portion of the housing, and wherein the lower media guide member includes a pair of cutout portions sized to receive respective ones of the pair of media exit guide portions when the access door is in the raised closed position.

2. The imaging device of claim 1, wherein with the fuser assembly installed within the imaging device and the access door in the raised closed position, the pair of media exit guide portions receive the leading edge of the media sheet when outputted from the housing, and wherein the pair of media exit guide portions and the upper and lower media guide members each include a plurality of ribs along a surface thereof for accommodating different angled leading edge curls.

3. The imaging device of claim 2, wherein the pluralities of ribs of the pair of media exit guide portions and the plurality of ribs on the upper and lower media guide member are offset with respect to another.

4. The imaging device of claim 1, wherein the media path is substantially shaped in an inverted S-shape and the media output area is located along a top portion of the imaging device.

5. The imaging device of claim 1, wherein the media redrive system further comprises a pair of reversible redrive rolls disposed along a portion of the media path channel adjacent the media output area and a top of the access door; and, the imaging device further comprises a controller in operative communication with the redrive rolls and the gate for controlling a direction of rotation of the redrive rolls and gate position, respectively.

6. The imaging device of claim 5, wherein when it is determined that a simplex printing operation is to be performed, the controller positions the gate to its first position and rotates the pair of redrive rolls in a first direction to output the media sheet to the media output area.

7. The imaging device of claim 5, wherein when it is determined that a duplex printing operation is to be performed on the imaging device, the controller positions the gate to its first position and rotates the pair of redrive rolls until a trailing edge of the media sheet is past the gate and then moves the gate from its first position to its second position and reverses the direction of rotation of the redrive rolls to direct the media sheet through the media path channel and the second exit to the duplex path portion of the imaging device for printing on the opposite side thereof.

8. The imaging device of claim 1, further comprising a plurality of guiding rolls disposed on the inner surface of the access door adjacent the first exit of the deflector.

* * * * *